United States Patent [19]

Grippi

[11] Patent Number: 4,697,717

[45] Date of Patent: Oct. 6, 1987

[54] RUBBER/PLASTIC STOPPER COMPOSITE WITH MECHANICAL ADHESIVE JOINTS

[75] Inventor: Nicholas A. Grippi, Nutley, N.J.

[73] Assignee: Becton, Dickinson and Company, Franklin Lakes, N.J.

[21] Appl. No.: 897,963

[22] Filed: Aug. 18, 1986

[51] Int. Cl.[4] ..... B65D 41/28

[52] U.S. Cl. ..... 215/354

[58] Field of Search ..... 215/354, 320, 247

[56] References Cited

U.S. PATENT DOCUMENTS

| | | | |
|---|---|---|---|
| 807,381 | 12/1905 | Hicks | 215/354 |
| 3,499,568 | 3/1970 | Riera | 215/37 |
| 4,465,200 | 8/1984 | Percarpio | 215/247 |
| 4,531,651 | 7/1985 | Donnelly | 215/354 |

*Primary Examiner*—Donald F. Norton

*Attorney, Agent, or Firm*—Robert P. Grindle

[57] ABSTRACT

A stopper is provided, particularly for evacuated blood sample tubes, comprised of a combination of thermoplastic and rubber, which combination utilizes a plurality of circumferentially spaced joints containing an adhesive. The joints serve to mechanically hold the composite body of rubber and plastic together. The arrangement reduces the quantity of rubber used while retaining its desirable sealing properties, and reducing the quantity of relatively inexpensive thermoplastic and its desirable strength properties. The invention takes advantage of the relatively good joining properties of a rubber-adhesive combination, and avoids the relatively poor joining properties of a thermoplastic adhesive combination.

5 Claims, 3 Drawing Figures

RUBBER/PLASTIC STOPPER COMPOSITE WITH MECHANICAL ADHESIVE JOINTS

BACKGROUND AND STATEMENT OF THE INVENTION.

Generally speaking, this invention relates to a stopper for closing containers. More particularly, this invention relates to a rubber/plastic stopper composite for use with evacuated tubes. Such tubes are particularly useful in taking blood samples from individuals for subsequent testing at a place separate from the place where the blood sample is taken. Accordingly, it is most important that the stopper provide superior sealing properties so that the evacuated nature of the tube is maintained until it is used, so as to obtain the proper quantity of a blood sample from the individual when the blood sample is being taken.

In the last several years, contamination from individuals in the environment where blood samples are being taken such as in a clinic, a doctor's office or in the hospital, has led to an increased use of single use throw away objects. That is, needles, syringes, lancets and any container containing a body fluid sample is used once and then discarded so as to avoid and/or reduce to a minimum the transfer of any disease from an individual from which a sample is taken to another individual, whether that individual is a technician of some kind or simply an individual handling used items in the vicinity where samples are being taken and/or tested.

One of the problems involved with the use of single use throw-away items is the fact that the cost of producing such items must be firmly controlled. For example, with respect to evacuated tubes for taking blood samples, many millions of such tubes are utilized on a yearly basis in the United States alone. Because of this, individual hospitals, in purchasing large quantities of such tubes, must take into consideration the cost. Thus, producers of such tubes must also take into consideration the cost in producing these tubes, and the materials involved.

One of the problems involved with evacuated tubes is producing stoppers for such tubes which will provide the necessary sealing properties to maintain the vacuum in the tube for a period of time sufficient to sustain adequate shelf-life prior to the use of the tubes. It has been found through many years of experience that elastomers such as natural and/or synthetic rubbers or a combination of these provide the best sealing properties between the cooperating surfaces of the stopper and the glass and/or plastic container. However, elastomers are relatively expensive in the quantities of stoppers used for throw-away evacuated tubes. Thus, many developments have been made in an effort to reduce the quantity of rubber used and to increase the quantity of thermoplastics which are, comparatively speaking, inexpensive. However, through many tests and use procedures, it has been found that plastics simply do not provide the same desired sealing properties for maintaining proper shelf-life of evacuated tubes.

In order to overcome the problems involved with the use of plastic as an inexpensive but less effective material, and rubber as a more expensive and much more effective sealing material, many developments have been made of combinations or composites of these materials to utilize plastic more and elastomer less. Representatives of such composite stoppers include, for example, the stoppers taught and claimed in the following U.S. patents.

U.S. Pat. No. 4,531,651 to Donnelly teaches a composite inner elastomer core and an annular surrounding plastic cap. This arrangement is appropriate for the purpose of reducing to a degree the amount of elastomer used. However, the thrust of the Donnelly patent is a particular complicated configuration of integral annular ridges in the plastic and the elastomer which cooperate with each other to hold the two parts together.

In this connection, in making literally millions of such stoppers, the molding procedures involved in producing such stoppers is also a very important price matter in the production. For example, any complicated or unusual arrangement of the various components that make up the composite increase the cost because molds have to be produced and maintained in order to make the complicated configuration of the sections making up the composite and the production line cost is increased if the complicated configurations require special handling arrangements to remove the molded parts from the mold, and to join them into the final composite. The Donnelly patent, for example, as mentioned above, includes cooperating annular ridges which hold the composite together and which increase the cost thereof because of these annular ridges. It should be borne in mind, when viewing the Donnelly structure, that a substantial amount of core in the form of an elastomer is still utilized for the composite taught and claimed in that patent.

A further stopper composite is taught in U.S. Pat. No. 3,499,568 to Riera. Riera teaches a composite in the form of two completely separate parts with an outer plastic part which is screwed onto the top of the container. Riera utilizes, therefore, the cooperating helical threads of the plastic and the container for maintaining his composite cap on his container. Riera recognized and uses a separate elastomer core portion for sealing the top of the container.

A further U.S. patent teaching a stopper composite is U.S. Pat. No. 4,465,200 which is a fairly recent patent covering a stopper composite and assigned to the assignee of this application. The invention taught in that patent is directed to a composite which provides for a well arrangement or a chamber in the top of the stopper which is formed by cooperation between the elastomeric core portion and the outer annular plastic cap portion to contain any blood droplets which may form on the top of the stopper when a blood sample is removed from the container. Again, cooperating flanges are formed on each portion of the composite in order to hold the composite together, and these cooperating flanges have the effect of involving a substantial cost in the formulation of the molds which make up each portion of the stopper, which comprises the ultimate composite stopper.

A further composite stopper development is taught in European Patent Publication No. 0150172 which is an invention of Konrad and assigned to C. A. Greiner and Son, Inc. The arrangement taught in this patent is a further very involved configuration wherein cooperating wedges on the inner elastomer core and the outer annular plastic cap serve to hold the two parts together. This arrangement, again, involves expensive utilization of molding and production facilities in order to provide the arrangement to complete the ultimate composite desired.

With the arrangement of this invention, by contrast, a composite stopper is provided which reduces to a minimum a quantity of elastomer utilized for providing the sealing properties for a stopper for a evacuated blood collection tube. Moreover, the cooperating structure utilized for holding the outer annular plastic cap together with the inner elastomer core is an extremely simplified arrangement of a plurality of circumferentially spaced holes placed or formed in the outer annular cap. These holes have the effect, when the composite is placed together, of providing a plurality of circumferentially spaced cooperating surfaces between the outer annular thermoplastic cap and the elastomer core. Placed in these cooperating surfaces is an adhesive material. That is, the Applicant herein has recognized and utilized the property of a conventional adhesive material which will adhere much more readily to an elastomer than to a thermoplastic material. For this reason, the holes formed in the plastic cap extend through the cap to the top surface of the elastomer so that once the two parts are joined together as a composite, the adhesive material merely has to be applied in one step to join the parts mechanically together utilizing the adhesive for this purpose. What is obtained is a relatively inexpensive, easily molded composite stopper for evacuated tubes of simplified configuration and construction. Nevertheless, the composite of the invention serves to properly seal the evacuated tube and to maintain proper shelf-life for an extended period of time until the tubes are actually used.

With the foregoing and additional objects in view, this invention will now be described in more detail, and other objects and advantages thereof will be apparent from the following description, the accompanying drawings, and the appended claims.

DETAILED DESCRIPTION OF THE INVENTION

Figure 1:
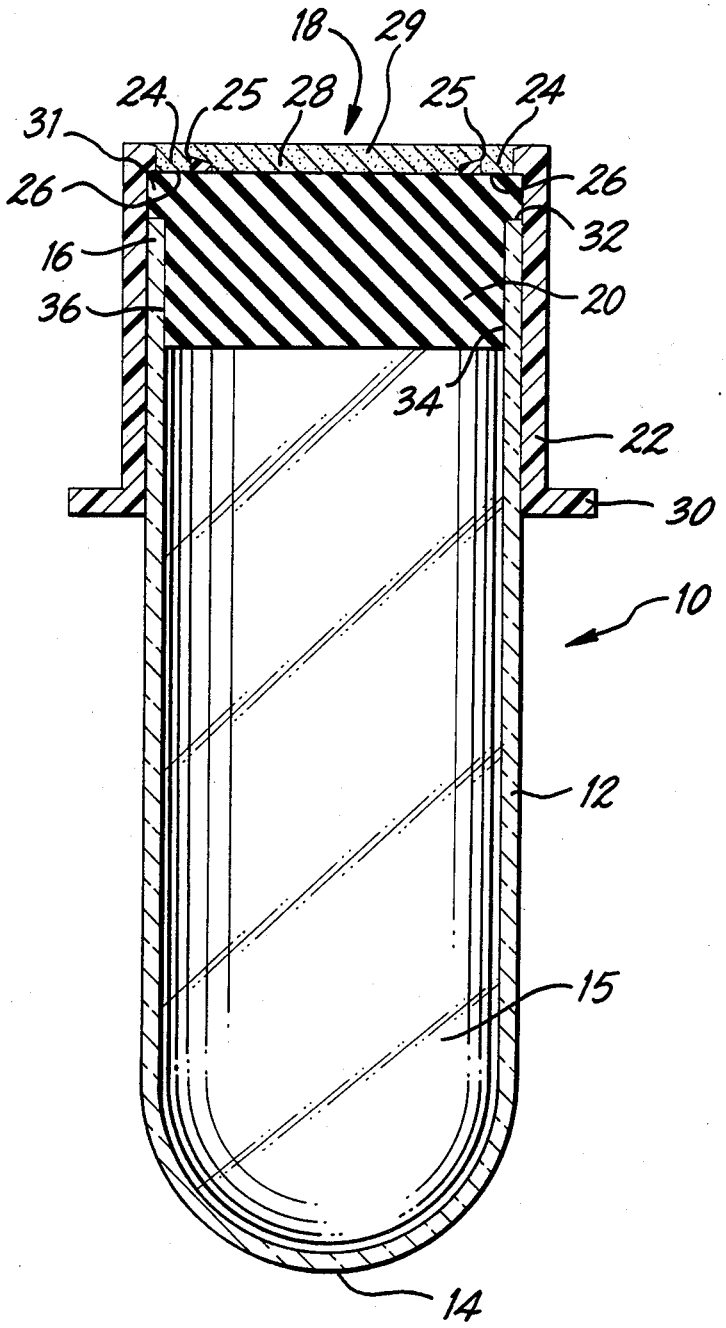
FIG. 1 is a longitudinal sectional view of an evacuated blood sample tube, with a composite closure assembly thereon illustrating the invention.

Referring to the drawings in which like reference characters refer to like parts throughout the several views thereof, in FIG. 1, a closure assembly generally designated 18 is shown placed on the open end 16 of an evacuated tube 12. Tube 12 is a conventional blood sample tube which may be evacuated for receiving, subsequently, a blood sample therein. The tube has an open end 16 and a closed end 14, defining a chamber 15 for receiving a blood sample. As will be understood by practitioners-in-the-art, tube 12 may have coated on the internal surface thereof materials which serve to react with a blood sample introduced therein for accommodating a subsequent particular blood test. Such tubes may also have introduced into them other materials for reacting with the blood sample, as required.

Figure 2:
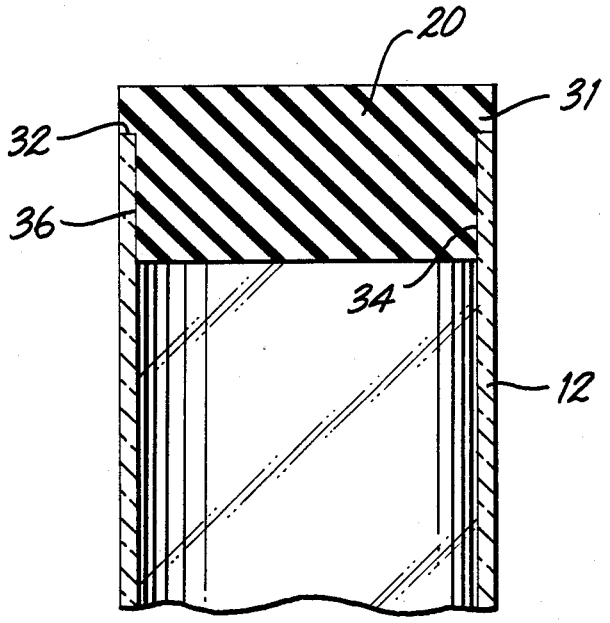
FIG. 2 is an enlarged sectional view of the elastomer portion of the composite of the invention seated in the top of an evacuated tube to indicate in detail the arrangement of the elastomer portion of the composite of the invention.

In accordance with the invention herein, a composite 18 comprised of a central elastomer core 20 and an outer annular plastic cap 22 is provided. As can be seen in FIGS. 1 and 2, the elastomer core 20 includes an annular integral flange 31 which extends over the top edge 32 of the open end 16 of tube 12. The elastomer core provides the proper sealing engagement along the surface 34 in the upper end of tube 12. The elastomer, as will be understood by practitioners-in-the-art, provides proper gripping and sealing between the surface 34 of tube 12 and the outer annular surface 36 of the elastomer core 20.

Figure 3:
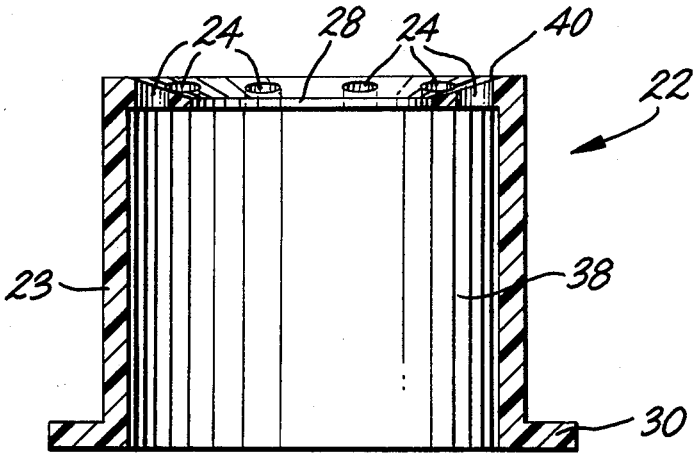
FIG. 3 is an enlarged sectional view of the annular thermoplastic outer portion of the composite of the invention showing the details of the arrangement thereof.

Referring to FIG. 3, an enlarged sectional view of the outer annular cap 22 of the composite of the invention is shown. Cap 22 includes an outer annular wall 23 ending at the lower end thereof in an annular flange 30. In viewing FIG. 1, it will be seen that flange 30 extends outwardly around tube 12 once the composite 18 is placed on the open end 16 of tube 12. The flange 30 serves as a gripping surface in order to remove composite 18 from tube 12 when required. Other gripping arrangements may be used such as knurled or ridged surfaces on annular wall 23.

As can be seen in FIG. 3, cap 22 includes a top surface 40 having disposed therein a plurality of circumferentially spaced bores 24, which are formed simultaneously with the formation of the cap 22. Also formed centrally in the top surface 40 of cap 22 is an opening 28 so that when the cap 22 is placed over the elastomer core 30, the top surface centrally of the elastomer core 20 is exposed as well as the surface 26 at the bottom of each of the individual circumferentially spaced bores 24. Thus, in the final formation of the composite 18 of the invention, an adhesive, #29, is placed over the top of the composite. The adhesive, #29, is in liquid form when placed thereon so as to allow the adhesive, #29, to fill each of the individual bores 24 in cap 22. As a result, the adhesive, #29, adheres to the exposed surfaces 26 at the bottom of each of the bores 24 which surfaces 26 are individual portions of the top surface of the elastomer core 20. Moreover, the adhesive forms in the opening 28 of annular cap 22 to spread out over the top surface of central elastomer core 20. When the adhesive cures and hardens, as will be understood by practitioners-in-the-art, it forms a mechanical joint between the elastomer core and the outer annular thermoplastic cap. In this connection, it should be understood that the upper openings 25 of each of the circumferentially spaced bores in cap 20 may be chamfered in order to increase the mechanical holding properties of the individual adhesive joints formed in each of the bores 24 in the cap 22.

The central elastomer core may be comprised of natural or synthetic rubber or combinations thereof. Other materials which may be utilized, as will be understood by practitioners-in-the-art, include butyl rubber, for example. With respect to the outer annular thermoplastic cap, it may be comprised of such materials as polyethylene or polypropylene. Other materials may include polystyrene or polycarbonate. With respect to the adhesive material which may be used to form the mechanical joint between the two parts of the composite, a representative adhesive includes various epoxies, for example. Other materials may include, for example "superglues" and silicone adhesives.

Thus, when the composite assembly of the invention is formed, then it may be mounted on the top of tube 12 and inserted into the open end 16 thereof. It should be understood, that although the composite assembly of the invention was developed specifically for use in evacuated tubes, any container which requires a positive seal may be closed with the composite of the invention. For example, microcollection tubes which are not evacuated may utilize the composite of the invention simply because it is a simplified composite of less detailed configuration and of substantially reduced cost.

Accordingly, there is provided in accordance with this invention a new composite closure assembly for, specifically, evacuated tubes for taking blood samples which closure assembly is substantially less costly to produce in the many millions that must be utilized on a yearly basis. Because of this, there is reduced overall cost in the operation of a hospital or clinic which requires the single use throw-away type items discussed in this applicatin. As purely illustrative of dimensions for the invention herein, for example, the verticle dimension of core 20 may be 5 millimeters while flange 31 may be 1 millimeter.

Moreover, the composite assembly of the invention herein is readily removable from an evacuated tube with the provision of the annular gripping flange 30 which provides a larger gripping surface and a certain amount of flexibility in removing the stopper composite from the sealing engagement thereof with an evacuated tube. The lower skirt of the annular cap of the composite of the invention serves to protect the technician from any blood that might escape from the open end 16 of tube 12 during this removal procedure.

As is apparent from the foregoing, the arrangements of apparatus provided in accordance herewith are readily and simply manufactured by mass production techniques in conventional molding procedures and the parts may be simply assembled and mounted on evacuated tube with a limited amount of effort.

While the apparatus herein disclosed forms preferred embodiments of the invention, this invention is not limited to this specific apparatus, and changes can be made therein without departing from the scope of this invention which is defined in the appended claims.

What is claimed is:

1. A closure assembly for evacuatable tubes for subsequently receiving samples of body fluids, comprising (a) an annular elastomeric stopper body for insertion into the open end of an evacuatable tube;
(b) an annular flange integral with said stopper body adjacent the top surface thereof for seating on the top edge of an evacuatable tube;
(c) a flexible thermoplastic cap mounted on said annular elastomeric body;
(d) a top surface on said flexible cap;
(e) an annular skirt depending from said flexible cap top surface for surrounding the upper outer surface of an evacuatable tube;
(f) a central opening in said top surface of said flexible cap for exposing the central portion of said stopper body;
(g) a plurality of circumferentially spaced bores extending through said top surface of said thermoplastic cap;
(h) said plurality of said bores surrounding said central opening in said top surface;
(i) a plurality of portions of a cured adhesive material in each of said spaced bores;
(j) said plurality of portions of adhesive material filling said bores and adhering to the top surface of said elastomeric stopper body at points adjacent each of said bores; and
(k) whereby said plurality of portions of adhesive material hold said elastomeric stopper body and said flexible thermoplastic cap together.

2. The assembly of claim 1, further characterized by
(a) each of said plurality of bores in said thermoplastic cap having a chamfered upper opening.

3. The assembly of claim 1, further characterized by
(a) an integral annular flange extending from the bottom edge of annular skirt of said thermoplastic plastic cap.

4. The assembly of claim 1, further characterized by
(a) said annular elastomeric body comprised of a material selected from the group consisting of natural rubber, synthetic rubber and mixtures thereof.

5. The assembly of claim 1, further characterized by
(a) said cap comprised of a material selected from the group consisting of polyethylene, polypropylene, polystyrene and polycarbonate.

* * * * *